US010316615B2

(12) United States Patent
Fitzhugh et al.

(10) Patent No.: US 10,316,615 B2
(45) Date of Patent: Jun. 11, 2019

(54) DEVICE AND METHOD FOR APPLYING FORCE TO A TUBULAR AND SEALING THE PASSAGE THERETHROUGH

(71) Applicant: Peak Completion Technologies, Inc., Midland, TX (US)

(72) Inventors: Bryan Fitzhugh, Midland, TX (US); William Sloane Muscroft, Midland, TX (US)

(73) Assignee: Peak Completion Technologies, Inc., Midland, TX (US)

( * ) Notice: Subject to any disclaimer, the term of this patent is extended or adjusted under 35 U.S.C. 154(b) by 118 days.

(21) Appl. No.: 15/247,897

(22) Filed: Aug. 25, 2016

(65) Prior Publication Data

US 2017/0058631 A1 Mar. 2, 2017

Related U.S. Application Data

(60) Provisional application No. 62/209,595, filed on Aug. 25, 2015.

(51) Int. Cl.

| | |
|---|---|
| ***E21B 23/01*** | (2006.01) |
| ***E21B 33/128*** | (2006.01) |
| *E21B 43/10* | (2006.01) |
| *E21B 47/00* | (2012.01) |

(52) U.S. Cl.

CPC ..... *E21B 33/128* (2013.01); *E21B 23/01* (2013.01); *E21B 43/10* (2013.01); *E21B 47/00* (2013.01)

(58) Field of Classification Search

CPC .... E21B 33/12; E21B 33/128; E21B 33/1208; E21B 33/134; E21B 23/01; E21B 23/02; E21B 23/03; E21B 23/06; E21B 43/10; E21B 43/1025; E21B 49/087

USPC ..... 166/195, 181, 182, 387

See application file for complete search history.

(56) References Cited

U.S. PATENT DOCUMENTS 5,273,109 A * 12/1993 Arizmendi ..... E21B 33/1292 166/123

2007/0221372 A1* 9/2007 Telfer ..... E21B 33/128 166/120

2010/0326675 A1* 12/2010 Doane ..... E21B 33/1216 166/387

OTHER PUBLICATIONS

Bakerline Completion Series Portfolio; downloaded from https://public.bakerhughes.com/bakerline/pdf/Bakerline%20Series_Portfolio.pdf.

(Continued)

*Primary Examiner* — Brad Harcourt
*Assistant Examiner* — David Carroll

(57) ABSTRACT

Devices and methods related to setting and testing a packer in a single trip are disclosed. Embodiments disclosed herein provide a tubing engagement element for applying longitudinal force to expand the packer element, such as by compressing an elastomeric element longitudinally to cause radial expansion. Further, upon application of longitudinal force, a second packer element, inside of the first, also sets, isolating the interior of the packer form the exterior. The isolation on the interior of the packer, or tubing attached thereto, permits formation of a pressure differential across the installed packer, facilitating a pressure test to ensure that the packers is adequately set.

17 Claims, 6 Drawing Sheets

(56) References Cited

OTHER PUBLICATIONS

D&L Snapset I Packer as described in the Snapset I Packer product sheet; downloaded from http://www.dloiltools.com/products/mechanical-set-packers/snapset-i-packer.
D&L Type DL-IB Tandem Tension Packer as described in the Type DL-IB Tandem Tension Packer product sheet; downloaded from http://www.dloiltools.com/products/mechanical-set-packers/type-dl-ib-tandem-tension-packer.

* cited by examiner

DEVICE AND METHOD FOR APPLYING FORCE TO A TUBULAR AND SEALING THE PASSAGE THERETHROUGH

STATEMENT REGARDING FEDERALLY SPONSORED RESEARCH OR DEVELOPMENT

Not applicable.

This application claims priority from U.S. Provisional Patent Application Ser. No. 62/209,595, filed on Aug. 25, 2015 and entitled Device and Method for Applying Force to a Tubular and sealing the Passage Therethrough, which is incorporated in its entirety herein by reference.

BACKGROUND

The embodiments disclosed herein and the invention as claimed relates to the installation of tubulars in a well or wellbore and particularly the installation and pressure testing of packer elements mechanically set by force applied to the top of the tubulars. Certain embodiments may be used with liner hangers having or connected with such mechanical set packers, the packers having sealing elements radially expanded by force applied to the top of the liner hanger assembly.

Field

The use of liners and liner hangers is well known in the art. A tubing string may be run into a well, often through a previously installed string or strings of casing, and secured to the previously installed casing once the tubing string reaches its desired position. Upon actuation of the liner hanger, slips or other holding devices radially expand to engage the casing. Such holding devices grip the casing and secure the liner, or other string, at the desired location and may hold the weight of the tubing string, which may exceed several hundred thousand pounds, so that the liner does not fall further down the well.

Another feature which may be incorporated into a liner hanger, such as the Sentinal™ liner hanger by Peak Completion Technologies, Inc., is a packer. Such packer is in place to prevent fluid communication between the annulus surrounding the liner and the region of the wellbore above the liner hanger. In some liner hangers, the packer is set by mechanical force applied to the top of the liner hanger assembly, such as to the top of a polished bore receptacle, or PBR, longitudinally compressing an elastomeric packer element between setting rings and/or thimbles and thereby radially expanding the elastomeric element out against the casing.

One challenge with such mechanical set liner hanger packers is ensuring that the packet is set. Once the packer is set, or believed to be set, the tubing string on which the liner was previously suspended is removed from the well. Removal of this travel string may also remove the setting assembly for applying setting force to the packer. Because the travel string may be thousands of feet long, it is desirable to pressure test the liner hanger packer before removing the travel string and the setting assembly connected to it. By verifying whether the packer is adequately set, the operator may avoid additional runs with a travel string and setting tool, thereby saving substantial time and money. Embodiments of the present disclosure provide an improved system and assembly for installing a liner hanger packer or other mechanically set packers by facilitating a pressure test of such packers prior to removing the setting assembly from within the well.

Embodiments of the present disclosure may facilitate pressure testing mechanical set packers by sealing off the interior of the tubing string on which such liner hanger packer is mounted. Specifically, embodiments of the present disclosure provide a setting assembly for applying longitudinal force to the top of the packer, either directly or through intermediate tubing. Application of the longitudinal force may also set a second packer inside the liner hanger, intermediate tubing, or other tubing to prevent fluid communication on the inside of the liner hanger. With the second packer set, fluid pressure may be applied to the top of the liner hanger and a leak off test, or other appropriate test, performed to verify that the liner hanger packer has established an adequate seal.

DETAILED DESCRIPTION

Figure 1:
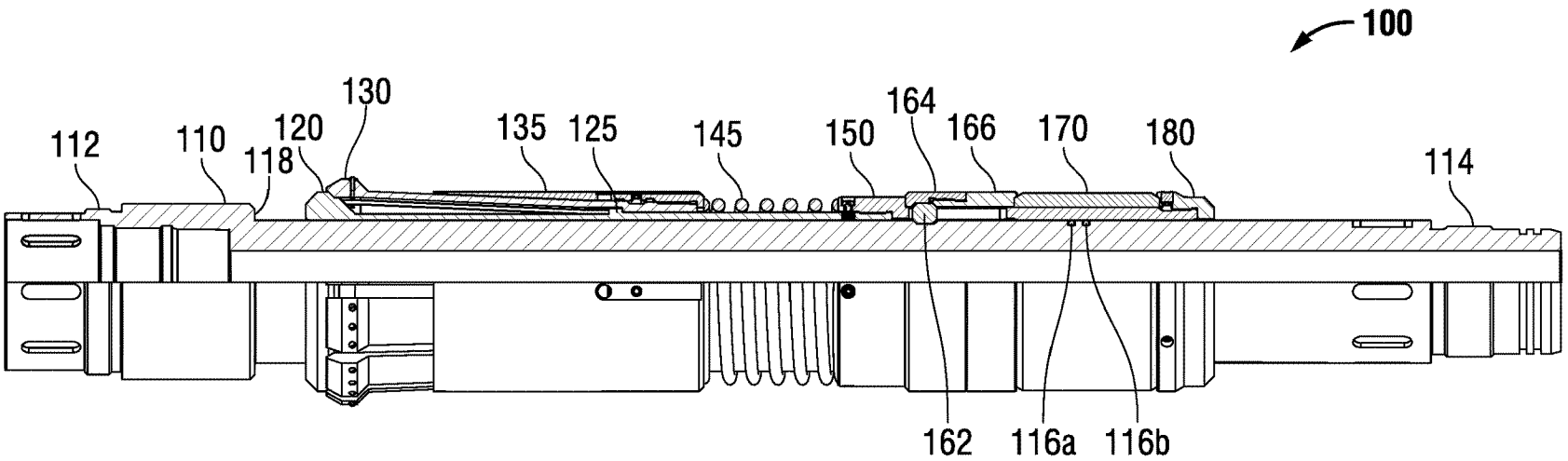
FIG. 1 is a sectional elevation of an embodiment setting tool according to the disclosure herein.
Figure 2A:
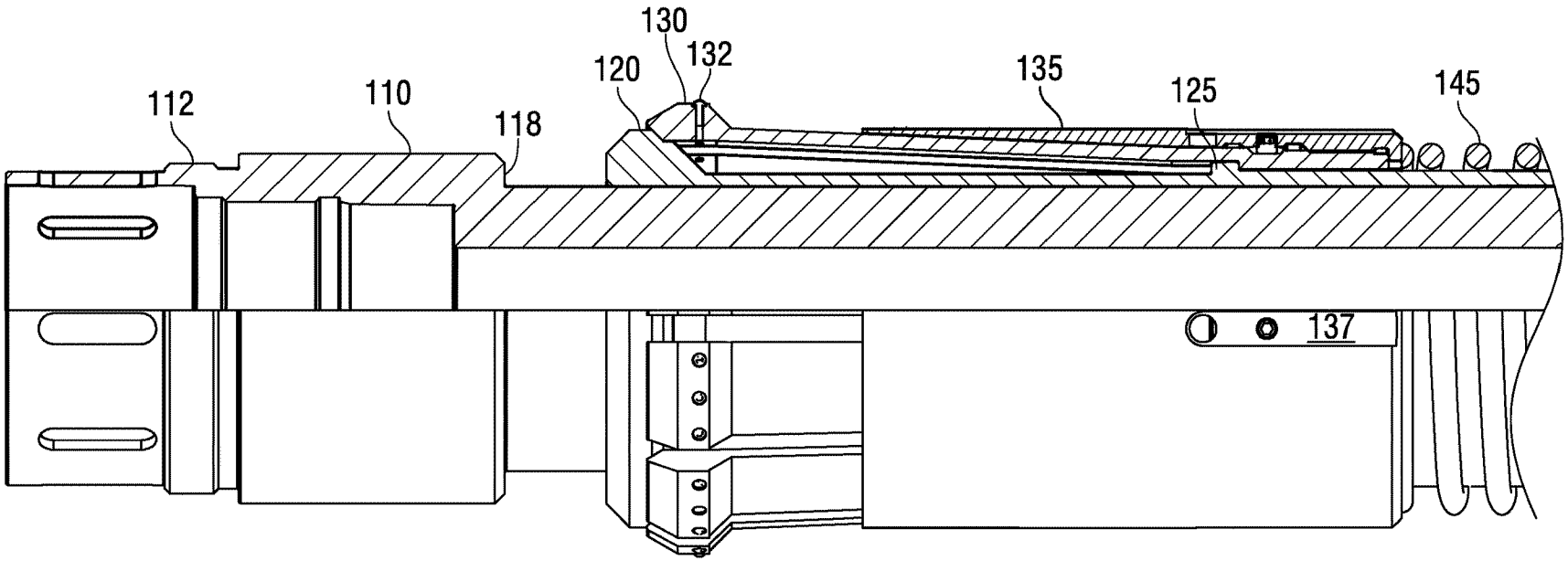
FIG. 2A is an enlarged sectional elevation of a portion of the embodiment setting tool of FIG. 1.
Figure 2B:
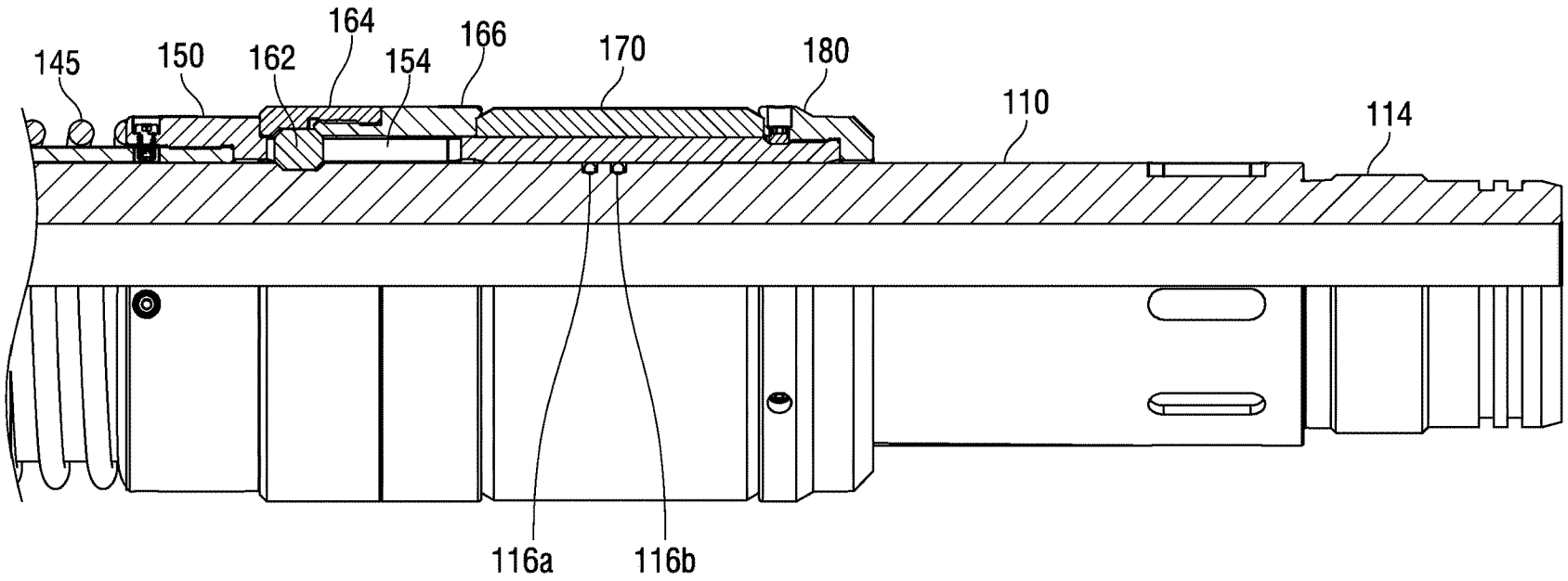
FIG. 2B is an enlarged sectional elevation of a portion of the embodiment setting tool of FIG. 1.

FIGS. 1, 2A and 2B show an embodiment tool 100 for applying a force to a tubing string, such as a liner, while sealing the interior of the tubing string against fluid communication. In one aspect, the tool may be used to set a mechanical portion of a liner hanger by applying downward force on a PBR while simultaneously sealing against the internal walls of the PBR.

Setting mandrel 110 extends through the tool 100 and may connect to additional devices above and below the tool 100. For example, setting mandrel 110 may be connected to the surface via a travel stung (not shown) at upper connection 112 and to a hydraulic setting tool (not shown) via lower connection 114. Collet support 120, element mandrel 150 and lower thimble 180, may be arranged around the setting mandrel 110. Collet 130, collet shroud 135, and spring 145 may be arranged around collet support 120. Upper thimble 166, thimble retainer 164, and element 170, may be arranged around element mandrel 150. Thimble retainer 164 and upper thimble 166 may be connected via threads. Seals 116*a* and 116*b* prevent fluid communication between the outer surface of setting mandrel 110 and the inner surface of element mandrel 150. Pins 162 may connect the thimble retainer 164 and upper thimble 166 to the setting mandrel 110, passing through a portion of element mandrel 150. Lower thimble 180 may be connected to the lower end of element mandrel 150 and is slidingly arranged around the setting mandrel 110.

In some embodiments, the end of collet 130 may contain friction pads 132, shown in FIG. 2A. Friction pads 132 may be comprised of brass or other material such that a PBR or other tubing against which the friction pads slide is not unacceptably marred, scratched or otherwise affected during operation of the tool.

Figure 3:
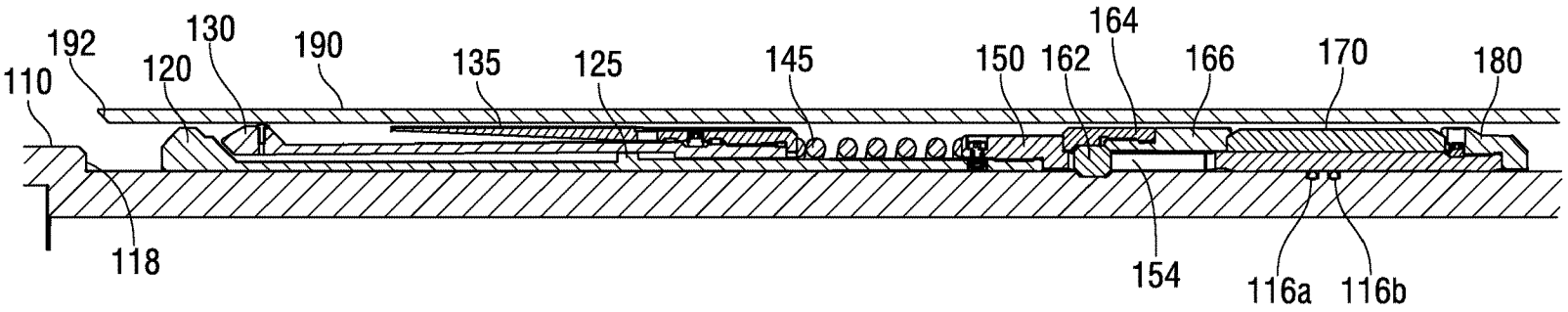
FIG. 3 is a sectional elevation of an embodiment setting tool in a run-in position.

FIG. 3 shows a run in position of one embodiment with the tool inside of a PBR 190. Spring 145 is compressed, providing a force that would tend to push the upper portion of collet 130 out of the PBR 190. Collet 130 is held in a retracted position by engagement of friction pads with the interior wall of the PBR. Further, the friction pads may, collectively serve as a centralizer, positioning the tool within the PBR such that collet support 120, collet shroud 135, thimble retainer 164, upper thimble 166, and other portions of the tool do not engage the inner wall of the PBR.

In some embodiments, tool 100 may be connected to a hydraulic setting tool, such as through lower connection 114. During run in of the liner, such hydraulic setting tool may be connected with the liner hanger and in communication with the slips such that fluid pressure applied to the hydraulic setting tool causes radial expansion of slips, setting the slips and securing the liner hanger into the surrounding casing. At a sufficiently high pressure, the hydraulic setting tool is released from the liner hanger, which frees the travel string, including tool 100, to move relative to the liner and liner hanger, including the liner hanger packer and PBR.

It will be appreciated that, in the embodiment of FIG. 3, PBR 190 functions to hold the collet 130 in the unset position and removal of the tool 100 from within the PBR allows the collet 130 to move to the actuated position. Thus, PBR 190 functions as a retainer element, holding the collet in a retracted position until the operator pulls up on the traveling string so that collet 130 is outside of PIM 190. Other retainer elements releasably holding the collet in a retracted position are within the scope of the present disclosure.

Figure 4:
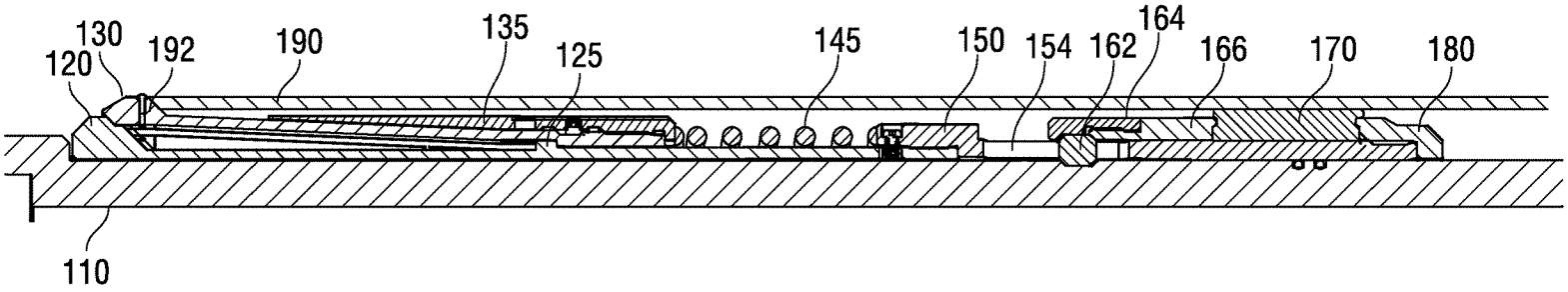
FIG. 4 is a sectional elevation of an embodiment setting tool in an actuated position.

FIG. 4 shows an embodiment tool in an engaged position, with the fingers of collet 130 engaged on an end 192 of PBR 190 and on a shoulder of collet support 120. The force of spring 145 may assist in pushing the fingers of collet 130 onto, and up, the shoulder of collet support 120. Spring stop 125 prevents movement of the collet 130, together with its attached collet shroud 135, past the engagement point of the collet fingers on the shoulder of collet support 120. Collet shroud 135 may have penetrations therethrough adjacent to the spring stop 125 in order to prevent fluid between spring stop 125 and the lower end of collet 130 from resisting movement of the collet 130 towards and onto collet support 120.

It will be appreciated that, in the configuration illustrated by FIG. 4, downward force applied to collet support 120 will push against collet 130, which in turn will turn push against PBR 190, or other tubing, providing downward mechanical force thereto, which may, for example, be used to set a mechanical set packer against casing below the PBR 190. For example, shoulder 118 of mandrel 110 may engage collet support 120 to apply such setting force. In this manner, collet support 120 and collet 130 may serve as a tubing engagement element for transferring longitudinal force from the travel string to the liner hanger or other tubing, though other tubing engagement elements are within the scope of the present disclosure.

As can be seen in the embodiment of FIG. 4, it is possible the setting mandrel 110 will not apply force to the collet support 120 until the packer elements 170 have been set. Specifically, pin 162 transfers the downward force of the mandrel to upper thimble 166. Element mandrel 150 is connected to collet support 120 so that engagement of collet fingers on the PBR 190 or other tubing, prevents movement of the collet support 120, element mandrel 150 and lower thimble 180 relative to the PBR 190. As setting mandrel 110 moves downward relative to the collet support 120 and element mandrel 150, pins 162 move within slots 154, causing thimble retainer 164 and upper thimble 166 to move as well. It will be appreciated that pins 162 do not require any specific form or shape and any embodiment pin—including without limitation balls, pegs, screws, dogs or other shapes—that sufficiently connect the setting mandrel 110 to the upper thimble assembly and may slide within the slots 154 of the element mandrel—may be used as a pin.

Collet support 120 may be connected to element mandrel 150 by threading, screws or other connections. Further, lower thimble 180 may be connected to element mandrel 150 as well. In such arrangements, movement of the setting mandrel 110 relative to the collet support 120, collet 130 and PBR 190 moves the thimble retainer 164 and upper thimble 166 at least partially independently of element mandrel 150 and lower thimble 180. This may occur due to engagement of collet 130 on end 192 of PBR 190, causing setting mandrel 110 to slide relative to the collet support 120, element mandrel 150, element 170 and bottom thimble 180.

Figure 5A:
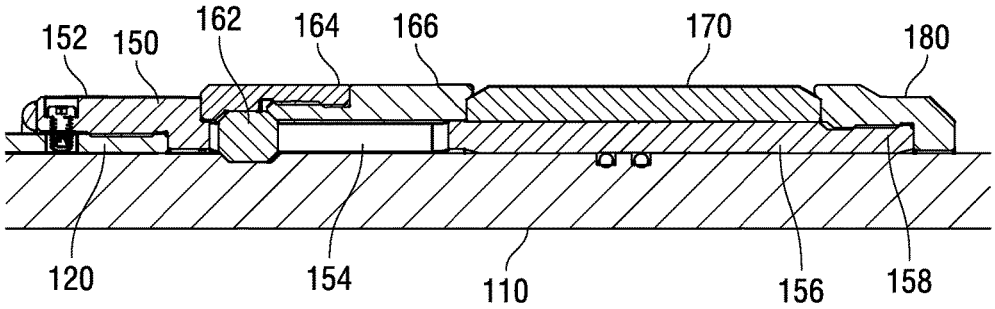
FIG. 5A is an enlarged cross section more clearly showing the packer section of the embodiment in FIG. 1.
Figure 5B:
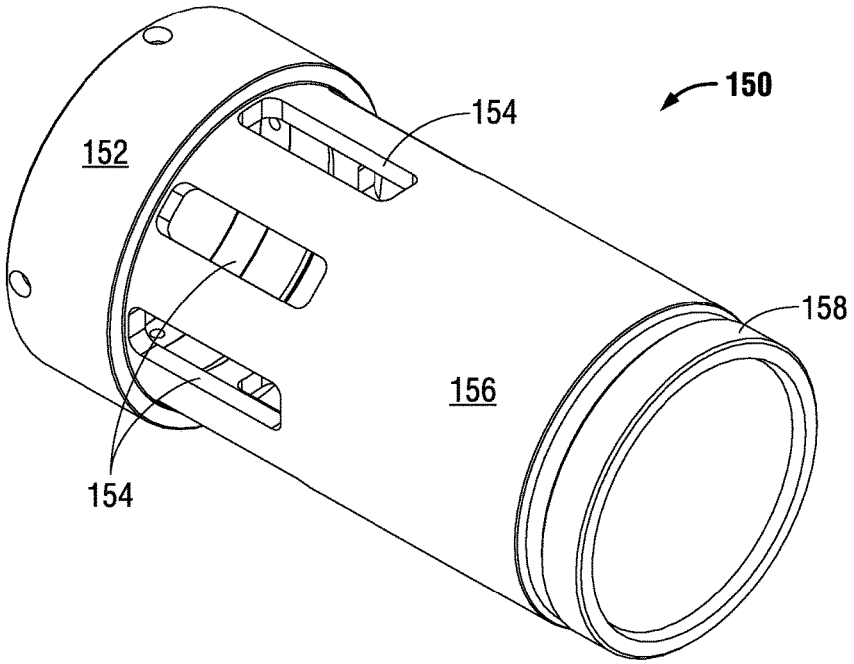
FIG. 5B is an orthogonal view of the element mandrel of the embodiment of FIG. 1.

FIG. 5A illustrates the relationship between the setting mandrel 110, element mandrel 150, and an upper thimble assembly, which may comprise thimble retainer 164 and upper thimble 166 with a plurality of pins 162. Element mandrel 150, also shown in FIG. 5B, has an upper end 152 connected to the collet support 120, slots or passages 154, a sealing section 156 for engaging element 170 and a lower thimble connector 158. Pins 162, positioned in a plurality of slots or passages 154 through the element mandrel 150, engage a groove in the setting mandrel 110. Pins 162 connect the setting mandrel 110 to the upper thimble assembly. Thus, movement of the setting mandrel 110 in the downward direction moves the pin 162, and therefore the thimble retainer 164 and upper thimble 166, without moving the element mandrel 150 and consequently the lower thimble 180. This causes the upper thimble 166 to move towards the lower thimble 180, compressing element 170 therebetween. Such compression sets the element 170 against an interior wall of PBR 190 creating a fluid seal therewith.

It will be appreciated that creation of a fluid seal inside the PBR 190 or other tubing may permit selectively flowing fluid around the outside of the PBR 190 or other tubing with which the tool 100 is engaged. For example, after setting the mechanical set packer, it may be desirable to test the integrity of the seal of such liner hanger packer against the casing into which it is set. If the packer is not sufficiently sealed, collet 130 is still engaged with the PBR 190 and additional force can be applied to the PBR 190 to further set the liner hanger packer. Thus, the embodiments herein provide a means for testing the set of such mechanically set packers before the traveling string, with the packer setting tool, is withdrawn from the hole.

The present disclosure includes preferred or illustrative embodiments in which specific tools are described. Alternative embodiments of such tools can be used in carrying out the invention as claimed and such alternative embodiments are limited only by the claims themselves. Other aspects and advantages of the present invention may be obtained from a study of this disclosure and the drawings, along with the appended claims. Further, it will be appreciated that, while embodiments described herein relate to tools installed in an unactuated position, embodiment tools having tubing engagement elements not requiring expansion to engage the selected tubing are within the scope of the present disclosure. Further, while the embodiment packer element is described as being compressed by two thimbles, other rings or devices may be used to set the packer element by movement of the setting mandrel relative to the element mandrel, including elements be swedging or other means of expansion.

We claim:

1. A downhole tool for use inside a tubing string, the downhole tool comprising:

a setting mandrel connected to a first thimble;

a tubing engagement element configured to radially expand and engage and end of the tubing string;

an element mandrel connected to a second thimble and the tubing engagement element;

a packer element between the first thimble and second thimble; and at least one pin positioned within a slot in the element mandrel and connecting the first thimble to the setting mandrel;

wherein the setting mandrel and the element mandrel slidably engage one another such that movement of the setting mandrel in a first direction compresses the packer element between the first thimble and the second thimble.

2. The downhole tool of claim 1 wherein the tubing engagement element comprises a collet.

3. The downhole tool of claim 1, the setting mandrel comprising a shoulder for applying force to the tubing engagement element.

4. The downhole tool of claim 1 wherein the tubing engagement element comprises a collet and a collet support.

5. The downhole tool of claim 4 wherein the setting mandrel further comprises a shoulder for applying force to the collet support.

6. The downhole tool of claim 1 further comprising tubing surrounding at least a portion thereof, wherein the tubing engagement element is a retractable tubing engagement element and the tubing maintains the tubing engagement element in the retracted position.

7. The downhole tool of claim 6 wherein the tubing is a polished bore receptacle.

8. An assembly for setting a packer adjacent the top end of a tubing string, the assembly comprising:

a setting mandrel connected to a first setting ring;

a tubing engagement element;

an element mandrel connected to a second setting ring; and an elastomeric element between the first setting and the second setting ring; and a plurality of pins disposed in slots in the element mandrel and connecting the setting mandrel to the first setting ring;

wherein, the element mandrel is slidingly arranged around the setting mandrel;

the tubing engagement element is configured to radially expand and engage the top end of the tubing string and apply longitudinal force thereto; and engagement of the tubing engagement element with the end of the tubing string prevents movement of the second setting ring in relation to said tubing.

9. The assembly of claim 8 wherein the tubing engagement element comprises a collet and a collet support.

10. The assembly of claim 9 wherein the collet support is connected to the element mandrel.

11. The assembly of claim 8, the setting mandrel further comprising a shoulder, wherein the shoulder is configured to apply force to the end of the tubing string through the collect fingers.

12. A method for pressure testing around a tubing string anchored in a well, the tubing string comprising an upper end and having a packer assembly therein adjacent the upper end;

the packer assembly comprising:

a setting mandrel connected to a first setting ring;

a tubing engagement element;

an element mandrel slidingly arranged around the setting mandrel and connected to a second setting ring and the tubing engagement element;

an elastomeric element between the first setting and the second setting ring; and a plurality of pins connecting the setting mandrel with the first setting ring, said pins positioned in slots in the element mandrel;

the method comprising:

partially removing the packer assembly from upper end of the tubing string;

radially expanding the tubing engagement element;

engaging the upper end of the tubing string with the tubing engagement element;

applying downward force to the setting mandrel, thereby moving the first setting ring toward the second setting ring and expanding the elastomeric element outward to seal against an inner surface of the tubing string.

13. The method of claim 12 further comprising holding the downward force on setting mandrel as fluid pressure is applied to the wellbore around the upper end of the tubing string.

14. The method of claim 12 wherein the tubing engagement element is a collet and the expanding step comprises pushing a plurality of collet fingers up one or more angular surfaces.

15. The method of claim 12 wherein the setting mandrel comprises a shoulder and further comprising applying downward force from the setting mandrel to the upper end of the tubing string through the collet.

16. The method of claim 12 further comprising reducing the downward force on the setting mandrel, thereby permitting the first setting ring and second setting to separate and breaking the seal between the elastomeric element and the interior of the tubing string.

17. The method of claim 12 wherein the moving step comprises moving the plurality of pins along the slots in the element mandrel.

* * * * *